US006513358B2

(12) United States Patent
Jonsson et al.

(10) Patent No.: US 6,513,358 B2
(45) Date of Patent: Feb. 4, 2003

(54) METHOD AND DEVICE FOR CONTROLLING FLATNESS

(75) Inventors: Lars Jonsson, Västerås (SE); Klaus Meyer, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/742,307

(22) Filed: Dec. 22, 2000

(65) Prior Publication Data

US 2002/0020198 A1 Feb. 21, 2002

(51) Int. Cl.[7] ..... B21B 37/28

(52) U.S. Cl. ..... 72/9.1; 72/11.7; 72/365.2; 700/154

(58) Field of Search ..... 72/7.1, 9.1, 11.7, 72/365.2; 700/154

(56) References Cited

U.S. PATENT DOCUMENTS

| | | | | | |
|---|---|---|---|---|---|
| 5,235,835 | A | * | 8/1993 | Sakai et al. | 72/9.1 |
| 5,373,545 | A | * | 12/1994 | Friedrich et al. | 378/72 |
| 5,960,657 | A | * | 10/1999 | Anbe et al. | 72/9.1 |
| 5,987,948 | A | * | 11/1999 | Neushutz et al. | 72/7.1 |
| 6,098,060 | A | * | 8/2000 | Yuan et al. | 706/26 |

FOREIGN PATENT DOCUMENTS

| | | | | |
|---|---|---|---|---|
| JP | 3-266007 | * | 11/1991 | 72/11.7 |
| JP | 11-2511 | * | 1/1999 | 72/9.1 |

* cited by examiner

*Primary Examiner*—Ed Tolan
(74) *Attorney, Agent, or Firm*—Dykema Gossett, PLLC

(57) ABSTRACT

A method for controlling flatness of a strip (1) of rolled material rolled to a first flatness target and coiled and that is subsequently uncoiled, and a system which employs the method. Measurements of the flatness of the strip (1) during rolling are compared to both the first flatness target and to a second flatness target, a Mill Flatness Target 2. A flatness target for each of one or more subsequent processes, a Post Rolling Flatness Target (PRFT) and a measured flatness error is used to adapt a control signal for a mill stand (5) to control and regulate the flatness of subsequent production of rolled material of the same specification. The adaption may be made using different statistical techniques including fuzzy logic and neuro-fuzzy logic control methods. In the preferred embodiment, flatness measurements after decoiling are also fed forward to at least one subsequent process 12 and used to adapt control signals to regulate flatness of the current strip in the subsequent process 12. The advantages include that the rolled strip is more flat after decoiling, and that flatness control over the strip in a subsequent process is more accurate.

26 Claims, 5 Drawing Sheets

METHOD AND DEVICE FOR CONTROLLING FLATNESS

TECHNICAL AREA

The invention is a control method and system for continuous and semi-continuous processes for the production of substantially long and flat sheet or strip of material such as copper, steel or aluminium. More particularly it is a method and system for flatness control for use in a rolling mill where strip is processed subsequent to a rolling operation.

BACKGROUND ART

In the rolling of strip and sheet materials it is common practice to roll a material to desired dimensions in a rolling mill stand and then feed the resulting strip to a coiler. In the coiler, the strip is wound up into a coil. Such coils are then taken off the coiler and after some time has elapsed moved on to subsequent processes such as annealing, slitting, or surface treatment processes and other processes. At the beginning of subsequent processing, the coil is unwound and the strip fed into the subsequent process.

The tension in the strip between a mill stand and a coiler is carefully monitored and it is known to measure tension distribution across a strip in order to regulate the flatness of the rolled material. In U.S. Pat. No. 3,481,194 Sivilotti and Carlsson disclose a strip flatness sensor. It comprises a measuring roll over which the strip passes between a mill stand and, for this example, a coiler. The measuring roll detects the pressure in a strip at several points across the width of the strip. The pressure represents a measure of the tension in the strip. The measurements of tension in the strip result in a map of flatness in each of several zones across the width of the strip. U.S. Pat. No. 4,400,957 discloses a strip or sheet mill in which tensile stress distribution is measured to characterise flatness. The measures of flatness are compared to a target flatness and a difference between measured flatness and target flatness is calculated, as a flatness error. The flatness error is fed back to a control unit of the mill stand, so as to regulate and control flatness in the strip in order to approach a zero flatness error.

Similarly U.S. Pat. No. 5,970,765 describes a method and apparatus for rolling strip in which a difference is computed between a strip evenness measured over the width of the strip, and a target evenness. Shape adjusting elements in the roll stands of a train of rolls are then operated such that the difference is minimised. The difference to target evenness is thus fed back or forward to other roll stands in the same train, or used in the same stand for a subsequent pass on the same strip in the case of a reversing stand. The method is said to produce an improvement of the surface evenness independently of the processes during cooling of the hot strip on the runout table and in the coil.

However, a problem arises during downstream or subsequent processing of the coiled strip. When the coiled strip is unwound and subsequently processed, it is often found that it does not have the same measurements of flatness as it had when it was measured before the strip was coiled up. This means that the strip does not have the same flatness after uncoiling as it had before coiling, introducing a flatness error into the strip product from a rolling mill.

SUMMARY OF THE INVENTION

It is an object of the invention to reduce flatness error in a strip. It is another object of the invention to reduce flatness error in a part of the length of a strip. It is a further object of the invention to reduce flatness error in a strip that is coiled after rolling. It is a yet further object of the invention to provide a method to measure error in flatness after coiling. Another object of the invention is to provide a flatness target for subsequent processes. Another further object of the invention is to provide a compensating factor with which flatness in both a rolling mill and subsequent processes may be improved.

The invention may be summarily described as a method in which flatness of a given strip after de-coiling is measured and compared to a second and length-dependent flatness target, Mill Flatness Target 2, and a second flatness error is determined which is used to adjust both the rolling of subsequent lengths of strip through a mill stand, and to control subsequent and downstream processes for the same given strip, as well as devices and a system for carrying out the method. By this means, an error in flatness at different positions along the length of a strip due to coiling may be detected and subsequently used to reduce or correct such errors.

The main advantage of the invention is that a strip of rolled material which is processed in subsequent processes after rolling may be produced to the required flatness with less error, and consequently less downgrading of product, scrap and waste.

Another advantage is that flatness error after de-coiling may be successively used to improve flatness of each production of strip rolled to the same strip specification. A further advantage is that the post rolling flatness measurements may be fed forward to subsequent downstream processes and used to provide improved flatness control during those processes.

BRIEF DESCRIPTION OF THE DRAWINGS

The present invention will be described in more detail in connection with the enclosed drawings.

DESCRIPTION OF THE PREFERRED EMBODIMENTS

Figure 1:
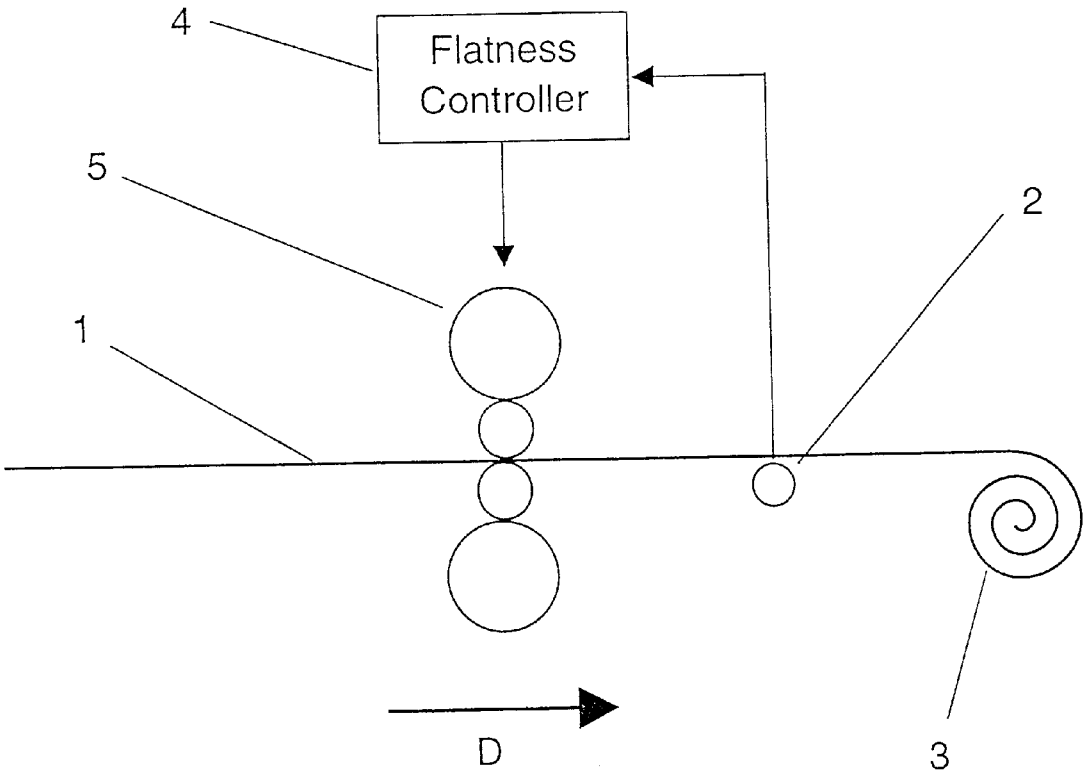
Figure 1 (Prior Art)
FIG. 1 (Prior art) shows schematically a part of a rolling mill including a flatness measuring roll, a mill stand and a coiler according to the known art.

In order to explain the invention, a method and device in the prior art will first be described in summary detail. FIG. 1 (Prior art) shows a metal strip 1 passing through a mill stand 5 in a direction shown by an arrow D. Strip 1 passes over a measuring roll 2 to a coiler 3. Measuring roll 2 is connected to a Flatness Control unit 4 which is in turn connected to a control unit of mill stand 5. Flatness Control unit 4 contains a pre-determined set of flatness values, a flatness target for the rolling process, here called Mill Flatness Target, for a given specification of strip.

Measurements of the strip corresponding to strip flatness are taken on exit from mill stand 5 by measuring roll 2 before coiling the strip on coiler 3.

Figure 2:
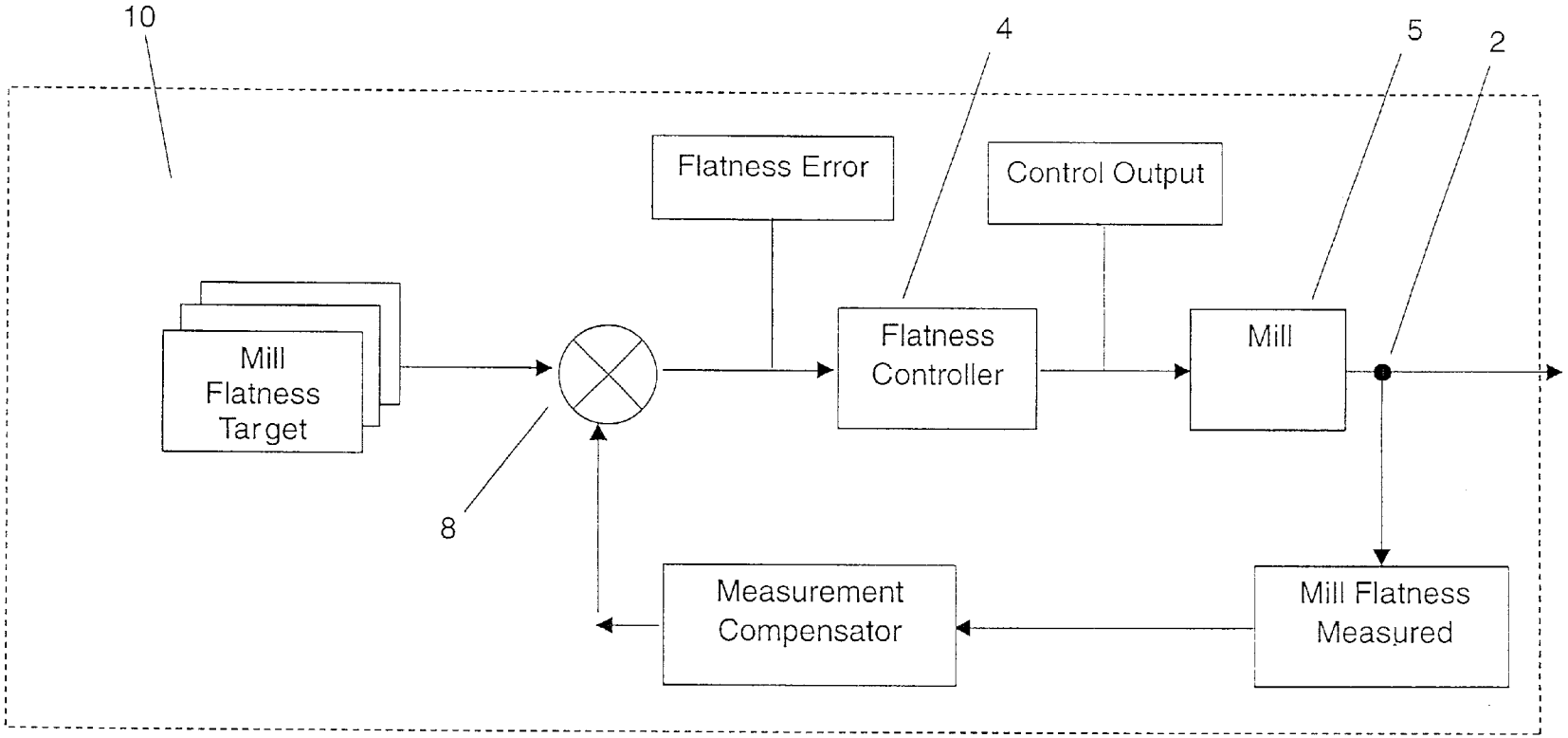
Figure 2 (Prior Art)
FIG. 2 (Prior art) shows a simplified block diagram for a method of flatness control with a Mill Flatness target according to the known art.

FIG. 2 (Prior art) shows a simplified block diagram for a known control method 10. A strip is rolled to the target flatness, Mill Flatness Target which is a function of width and which may also expressed as f(w). Flatness per zone across the width of the strip during rolling is measured at 2. The difference, which here is described as a first flatness error, between Mill Flatness target and measured values is processed in a Measurement Compensator and a summator 8 then sent to the Flatness Controller 4. The difference between a measured and compensated flatness and the Mill Flatness Target per zone, the first flatness error, is used by the Flatness Controller to provide one or more control signals which are fed back to at least one mill stand 5 before the measuring roll 2 in order to reduce the deviation from the required flatness in the zone, as defined by the Mill Flatness Target for the strip. The Mill Flatness Target is applied across the width of the strip and the target does not change depending on the length of the strip. This method forms part of the state of the art.

Figure 4:
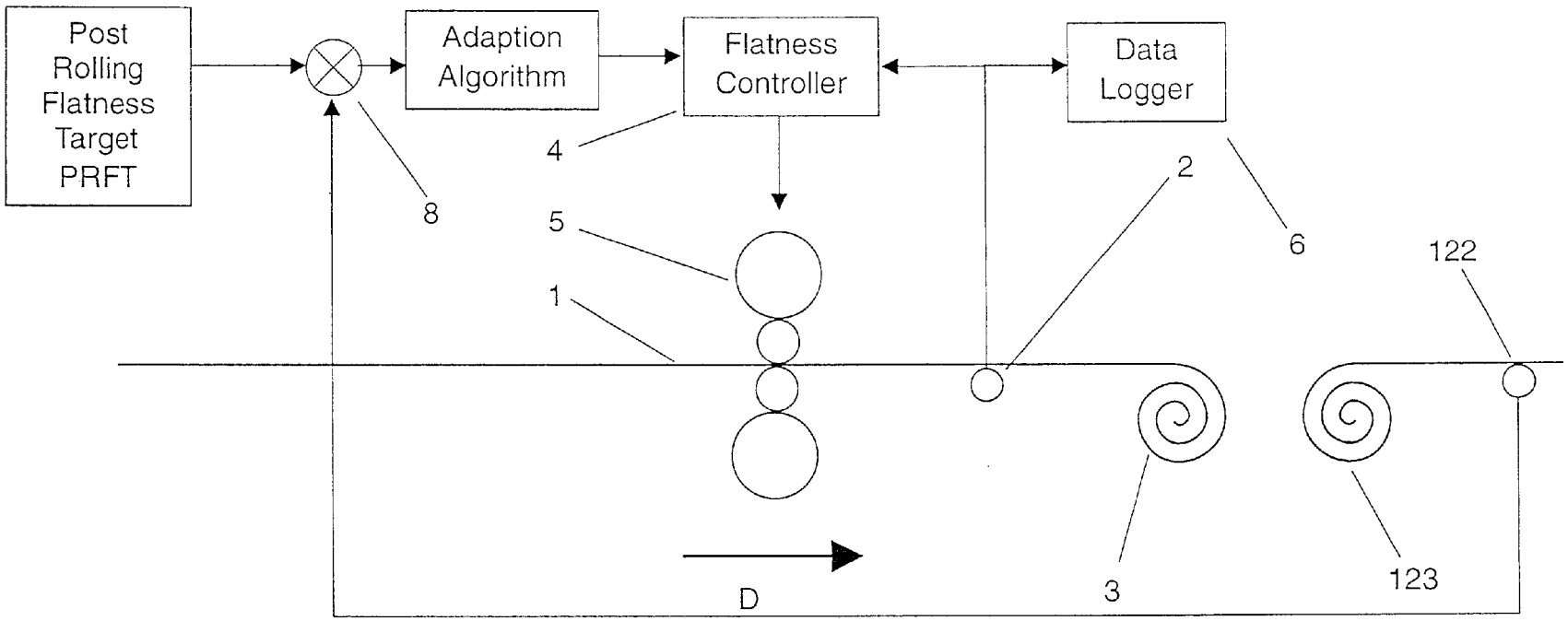
FIG. 4 shows a diagram for flatness control for a strip of rolled material according to an embodiment of the present invention.

In the method according to the present invention a strip 1 is rolled and identified using a coil identification data which, together with the flatness data and flatness system information before coiling for the given strip 1, is stored in a data logger 6 shown in FIG. 4. After coiling, the given strip 1 is moved to a subsequent process 12, as shown schematically in FIG. 5.

Figure 3:
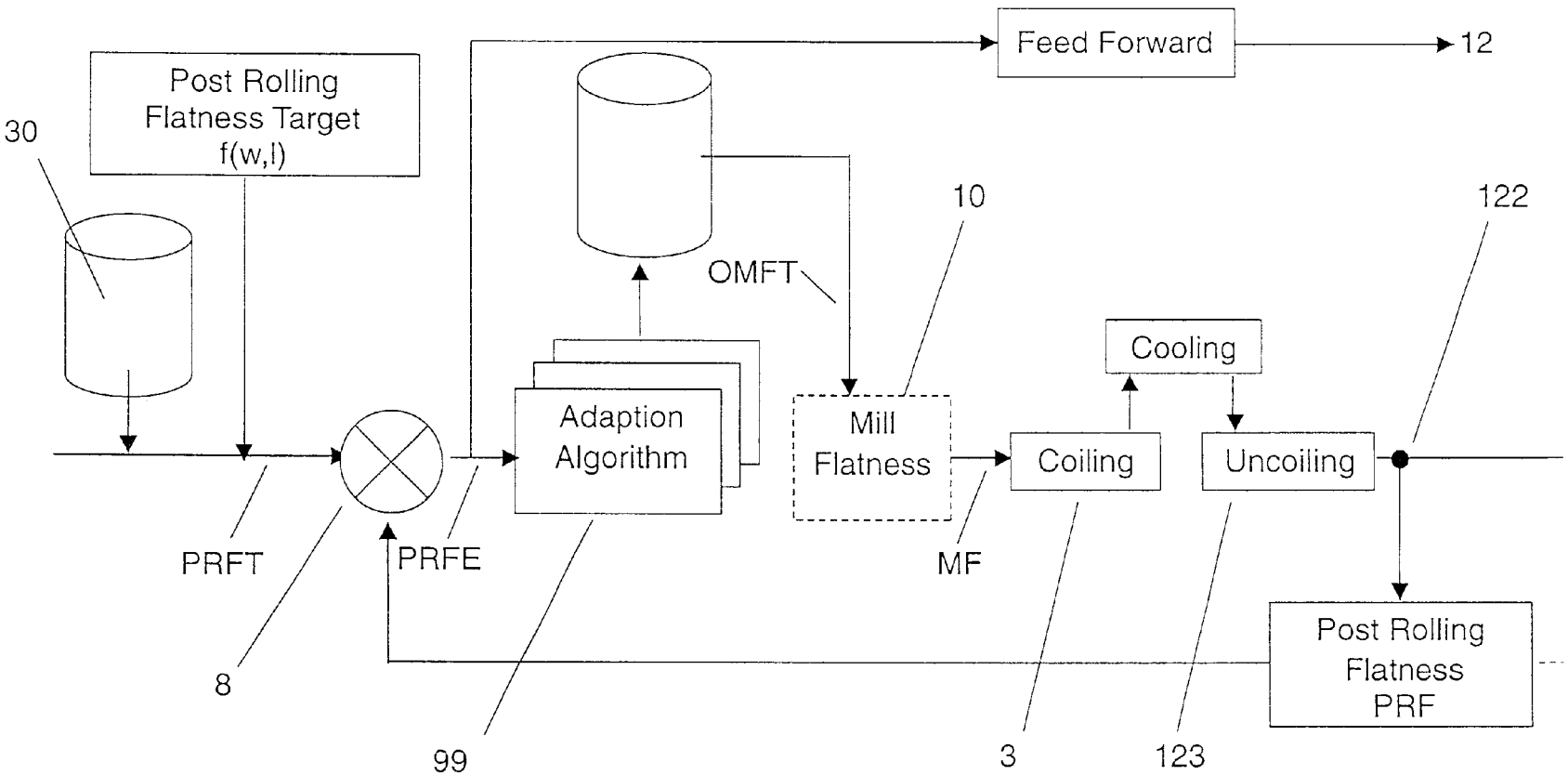
FIG. 3 shows a simplified block diagram for method of flatness control for a strip of rolled material according to an embodiment of the present invention.

FIG. 3 shows a control method for rolling strip according to the preferred embodiment of the invention. A second flatness target for rolling strip, a length dependent Mill Flatness Target (MFT2) is formed in which the flatness in any zone may vary over the length of the strip being rolled. A third type flatness target, a post rolling flatness target PRFT is also formed. The or a PRFT is a target for flatness of the strip with respect to each of one or more subsequent processes. The or each PRFT is produced from data stored in a database 30 and based on a specification related to a subsequent process of strip. The PRFT also differs from the Mill Flatness target of the prior art because it may change in any zone depending on the length of the strip. In the PRFT, flatness is a function of both width and length, which may also be expressed as f(w, l).

A strip is rolled as shown schematically in FIG. 3. Referring next to FIG. 4. After rolling and coiling at 3 the strip is subsequently uncoiled and led into a subsequent process. According to the present invention the coil is uncoiled, at uncoiler 123 and measured for flatness after uncoiling at 122 before passing into a subsequent process 12. After coiling, flatness errors can occur in the strip which depend on a length position in the strip, because flatness can be affected by position of the strip in the coil. Temperature and heat distribution in lengths of strip close to the centre of the coil vary compared to length of strip which are near to the outside of the coil.

Measurements of flatness after uncoiling are taken at 122 and compared to the PRFT following uncoiling, and the difference between measured flatness and PRFT target, called here the Post Rolling Flatness Error (PRFE) is calculated.

The Post Rolling Flatness Error PRFE is calculated by subtracting the Post Rolling Flatness Target PRFT from the measured Post Rolling Flatness PRF. Part or whole of the Post Rolling Flatness Error PRFE is supplied to an Adaption Algorithm 99 which calculates a new mill flatness target for the rolling mill, which new target is described here as an Optimised Mill Flatness Target (OMFT). The OMFT is similar to the Mill Flatness target of the prior art to the extent that it contains a target for flatness in each zone across the width of the strip and different from the Mill Flatness target of the prior art because the flatness in any zone may change along the length of the strip. The OMFT is passed to the mill controller as a new flatness target, and it is used to optimise the second Mill Flatness Target MFT2 in respect of one or more post rolling flatness targets PRFT for one or more subsequent processes.

As described, a part of the PRFE is used in an Adaption Algorithm 99 to create the OMFT. The OMFT is used as a mill flatness target in 10 so that the post rolling flatness error PRFE (following uncoiling) is substantially reduced to zero in subsequent rolling of strip of the same specification of the known strip 1.

The proportion of the second flatness error used to modify the Mill Flatness Target and so produce the OMFT according to the invention may be calculated using different methods. In an embodiment of the invention, a predetermined percentage of the value of the PRFE is used in the Adaption Algorithm 99 and applied as a compensation factor to form the OMFT.

The difference between measured flatness and the OMFT is used to regulate the mill stand 5 so as to minimise the difference detected by flatness measuring roll 2 and the OMFT when subsequently rolling lengths of strip.

Alternatively a filter may be applied to the PRFE. The filter may be a mathematical model implemented as an algorithm. In a development of the invention, the proportion of the value of the flatness error applied as a compensation factor to modify the OMFT may be selected using a fuzzy logic system to determine an optimum proportion of the value. In another development of the invention, the proportion of the value of the flatness error applied as a compensation factor to modify the OMFT may be selected using a neural network to determine an optimum proportion of the value.

PRFE and OMFT are vectors and can be of different size. The Adaption Algorithm 99, which can also be described as a controller, can be any kind of multiple input—multiple output (MIMO) controller, including but not limited to the following:

MIMO-PID controllers. The most elementary controller would be a P control such that OMFT=½× PRFE, where ½ is an arbitrary proportional factor of the controller. This is a similar method to calculate a predetermined percentage of the PRFE, as described above.

MIMO Fuzzy controller. An example is a set of n fuzzy controllers, in which each one has as inputs membership functions of the value and of the derivative of one element of the error vector PRFE. A set of typical fuzzy rules that may be used are known as Takagi-Sugeno FLC-1 or FLC-2 which, after de-fuzzification, gives the output vector OMFT.

MIMO model-based controllers such as IMC, fuzzy, $H_\infty$, or sliding mode.

Neuro, neuro-fuzzy controllers and other equivalent controllers that use optimizations based on gradient-descent methods.

Adaptive control, adaptive internal model control, robust and robust adaptive controllers (robust adaptive partial pole placement, robust adaptive model reference control, robust adaptive $H_2$ optimal control, robust adaptive $H_\infty$ optimal control).

In a first production of a strip 1 of a particular specification, the MFT2 is a predetermined reference value which may even be a constant value over the length of the strip, per zone. However after each production run for a strip of the same specification which passes through a subsequent process such as uncoiling, a PRFE is measured. The OMFT which is derived from part of the PRFE is successively refined and applied to the MFT2 in the rolling mill so that the PRFE of successive coils produced after the first production of strip entering their respective subsequent processes approaches zero.

In practice, a PRFT may be developed for several or all processes subsequent to a rolling mill operation. This means that a different PRFE for each of more than one subsequent process may be fed back to modify the OMFT. In this description, the term subsequent processes is used to mean operations of coiling or uncoiling, as well as any other processes subsequent to a rolling operation, such as annealing, etc.

Figure 5:
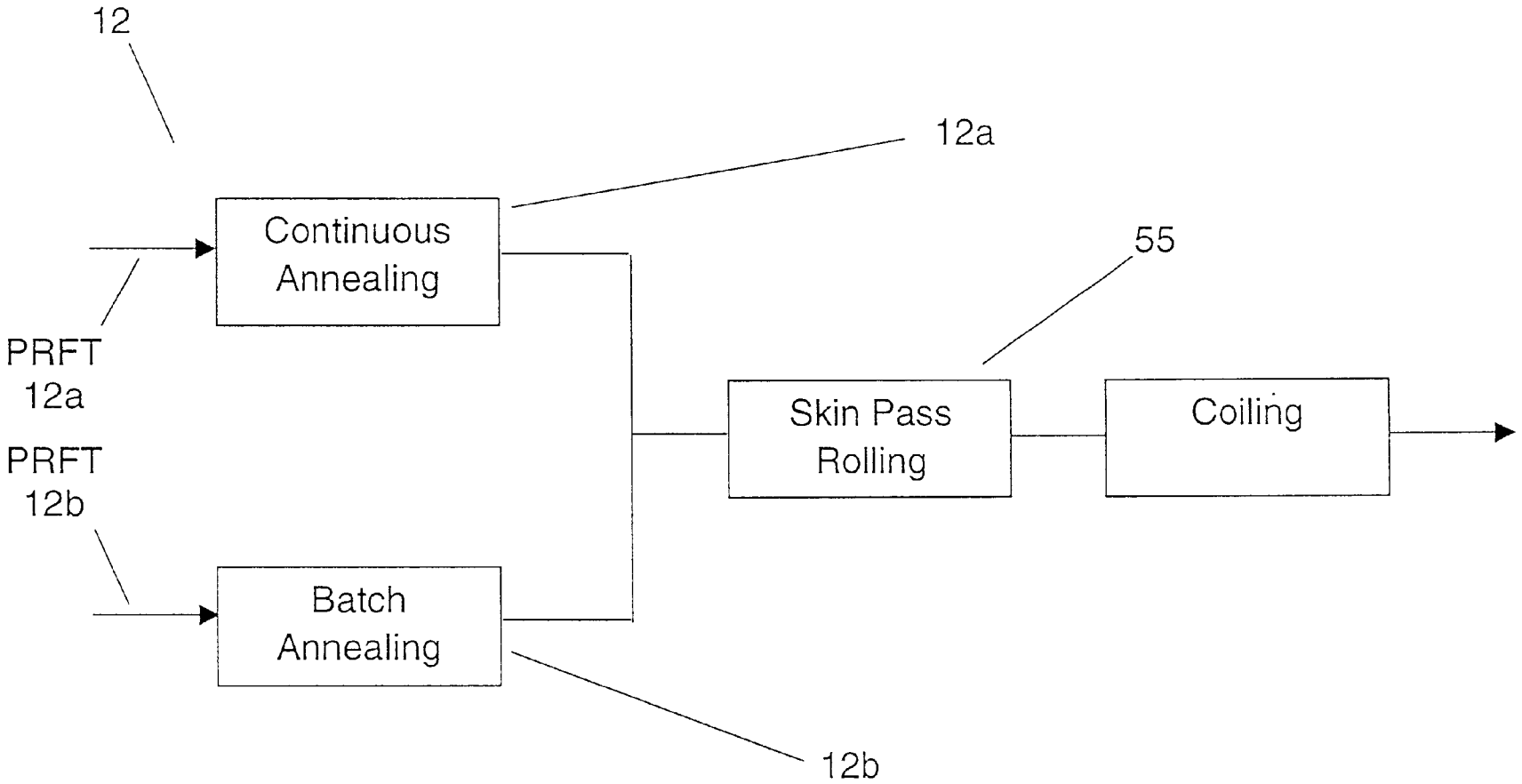
FIG. 5 shows a diagram of a method for flatness control for a strip of rolled material in subsequent processes according to an embodiment of the present invention.

In a further embodiment of the invention, the PRFE and the flatness measured after uncoiling is also used in a feed forward control method. After a strip is uncoiled it is led into a subsequent process. FIG. 5 shows a subsequent process 12, which represents an example of any process subsequent to uncoiling strip 1. This example shows a batch annealing process 12*a* and a continuous annealing process 12*b*. The second flatness error as shown in FIG. 4 measured after uncoiling a coil at 122 per given coil of strip, is fed forward to a subsequent process such as process 12.

For example, during a subsequent process 12 the flatness may be measured and compared to a target flatness for, for example, flatness of the strip following an annealing process. FIG. 5 shows by way of example a PRFT 12*a* flatness target for Continuous Annealing and another target PRFT 12*b* for Batch Annealing. Deviations, flatness error, between measured and target values for the incoming uncoiled strip may be used to adapt process parameters for the strip entering the process. According to the preferred embodiment of the invention the PRFT and or PRFE, and the OMFT, may also be used in the control of at least one subsequent process to compensate for anticipated changes in flatness due to coiling/uncoiling or any other process following rolling. Differences or error between PRFT and measured flatness may be determined in a subsequent process control unit (not shown) and used, for example, to regulate a light trimming mill stand for Skin Pass Rolling (55) in which a skin pass may be used to make a further and usually small reduction of perhaps only 0.75% in strip thickness. The skin pass rolling is adapted with part of the error between PRFT and measured flatness. Flatness control for the production of strip is made more accurate using a feed forward control method in this way.

What is claimed is:

1. A method for generating a flatness target for controlling flatness of a strip of rolled material, said method comprising the steps of:

measuring the flatness of the strip in at least one zone after passing through a mill stand;

generating a control signal for the mill stand to control and regulate the flatness of the rolled material by comparison to a first predetermined mill flatness target;

passing the strip through a discontinuous subsequent process;

measuring a post rolling flatness PRF in the at least one zone in at least part of the length of said strip of rolled material following the subsequent process;

forming a second and length dependent Mill Flatness Target MFT2 for the strip in which the target value for flatness in said at least one zone is dependent on position along the length of the strip; and modifying the Mill Flatness Target MFT2 based upon the post rolling flatness PRF.

2. The method according to claim 1, wherein modifying includes the further steps of:

comparing the measured flatness PRF of said strip to a post rolling flatness target PRFT;

calculating a post rolling flatness error PRFE; and adapting at least part of the post rolling flatness error PRFE to form a third, length dependent and optimised mill flatness target OMFT.

3. The method according to claim 2, including the step of adapting part of the post rolling flatness error PRFE by means of an Adaption Algorithm.

4. The method according to claim 3, wherein the Adaption Algorithm is a MIMO-PID controller such that OMFT=½ x PRFE where ½ is an arbitrary proportional factor of the controller.

5. The method according to claim 3, wherein the Adaption Algorithm is a MIMO Fuzzy controller comprising a set of n fuzzy controllers, of which each one has as inputs membership functions of the value and of the derivative of one element of the error vector PRFE.

6. The method according to claim 3, wherein the Adaption Algorithm is a MIMO model-based controller such as IMC, fuzzy, Hm, sliding mode type.

7. The method according to claim 3, wherein the Adaption Algorithm is a neuro or neuro-fuzzy controller that uses optimizations based on gradient-descent methods.

8. The method according to claim 3, wherein the Adaption Algorithm comprises an adaptive controller or adaptive internal model controller or robust or robust adaptive controller.

9. The method according to claim 2, including the step of supplying the measured post rolling flatness PRF to a feed forward control loop of at least one subsequent and downstream process.

10. The method according to claim 2, including the step of supplying the post rolling flatness error PRFE to a feed forward control loop of at least one subsequent and downstream process.

11. The method according to claim 1, wherein the subsequent process comprises uncoiling a strip.

12. The method according to claim 2, including the step of storing flatness measurement data for each strip together with data identifying each strip.

13. The method of claim 1, comprising the steps of employing a computer data signal embodied in a data communication system comprising calculating information derived from the measurements of flatness of the rolled strip and the target for flatness for said rolled strip, wherein said calculated information in said data signal is dependent on the second and length dependent Mill Flatness Target (MFT2) in which target flatness in the zone of a strip of rolled material varies along the length of the strip, and sending said data signal to a control unit of the rolling process forming a new flatness target to regulate successive rolling of strip rolled in the same rolling process.

14. The method of claim 13, further comprising forming the second Mill Flatness Target (MFT2) and sending a feed forward signal to a control unit of a subsequent process to regulate the flatness in the subsequent process for said rolled strip.

15. The method of claim 1, wherein a data format for a database of the system for generating a flatness target for controlling flatness of a strip of rolled material comprises stored information derived from the measurement of flatness of the rolled strip, wherein said data format comprises a data part containing said measured information of flatness wherein flatness measurements in each zone along the whole length of the rolled strip are recorded and an identification part containing coil identification data to identify the individual rolled strip.

16. The method of claim 1, further comprising employing a computer program product comprising computer code means or software code portions for enabling a computer or a processor carry out one or more of a series of instructions to enable the computer to carry out the steps of the method including at least one of an algorithm, a mathematical model, a fuzzy logic system or a neural network system.

17. The method of claim 16, wherein the computer program is contained in a computer readable medium.

18. The method according to claim 1, wherein the subsequent process is one of:

patch annealing;

continuous annealing; and skin pass rolling.

19. A system for controlling flatness of a strip of rolled material, comprising a rolling mill equipped with a mill stand, a flatness control unit containing a first mill flatness target, and a measuring roll, and a coiler, a subsequent process, at least one flatness measuring unit, at least one data logger, a decoiler and at least one subsequent process control unit, arranged with a second and length dependent flatness target MFT2 and a post rolling flatness target PRFT, wherein the at least one flatness measuring unit is arranged after the subsequent process, said flatness control unit being arranged to compare measured flatness of said strip after the subsequent process with the second mill flatness target MFT2 to thereby modify the MFT2.

20. The system according to claim 19, wherein said flatness control unit is further arranged to calculate a flatness error PRFE, said control unit being arranged to generate a control signal based in part on the flatness error PRFE calculated after the subsequent process.

21. The system according to claim 20, wherein part of the post rolling flatness error PRFE is adapted by means of an Adaption Algorithm to form the control signal.

22. The system according to claim 20, wherein the control signal is sent to a feed forward control loop in a control unit for a subsequent process.

23. The system according to claim 19, wherein flatness of a strip is controlled during rolling, after production of a previous strip of the same type as the strip being rolled.

24. The system according to claim 19, wherein flatness of the strip is controlled during subsequent processes applied to the strip.

25. The system according to claim 19, wherein a light trimming mill stand is controlled during a subsequent skin pass rolling process applied to the strip.

26. The system according to claim 19, wherein the subsequent process is a continuous process.

* * * * *